US005332949A

United States Patent [19]

Kim

[11] Patent Number: 5,332,949

[45] Date of Patent: Jul. 26, 1994

[54] STRUCTURE AND DRIVING METHOD OF A PLASMA DISPLAY PANEL

[75] Inventor: Dae-il Kim, Suwon, Rep. of Korea

[73] Assignee: Samsung Electron Devices Co., Ltd., Kyungki-do, Rep. of Korea

[21] Appl. No.: 977,029

[22] Filed: Nov. 16, 1992

[30] Foreign Application Priority Data

Mar. 4, 1992 [KR] Rep. of Korea ..... 92-3565

[51] Int. Cl.[5] ..... G09G 3/10

[52] U.S. Cl. ..... 315/169.4; 315/169.1; 315/168; 313/584

[58] Field of Search ..... 315/169.4, 169.3, 169.2, 315/169.1, 168; 313/584, 585, 586, 590

[56] References Cited

U.S. PATENT DOCUMENTS

| | | | |
|---|---|---|---|
| 4,665,345 | 5/1987 | Shionoya et al. | 315/169.4 |
| 4,754,203 | 6/1988 | Murakami | 315/169.4 |
| 4,996,460 | 8/1989 | Kim et al. | 313/586 |
| 4,999,541 | 8/1989 | Kim et al. | 313/584 |
| 5,138,225 | 5/1991 | Kim et al. | 313/584 |
| 5,144,200 | 5/1991 | Kim | 313/584 |
| 5,210,469 | 5/1993 | Kim | 315/169.4 |

*Primary Examiner*—Robert J. Pascal
*Assistant Examiner*—Haissa Philogene
*Attorney, Agent, or Firm*—Leydig, Voit & Mayer

[57] ABSTRACT

A plasma display panel includes stripe-like anodes and barrier ribs on an upper face plate, first sustaining electrodes over the inner surface of a lower rear plate, and stripe-like cathodes on the first sustaining electrodes insulated from the first sustaining electrodes by interposing layers. The stripe-like cathodes are respectively connected to external capacitors via a common node and serve as second sustaining electrodes. In a driving method of the panel, the first sustaining electrode is supplied with a pulse varying from ground potential to a first positive potential, from the positive potential back to ground potential, and then from ground potential to a first negative potential. The second sustaining electrode is supplied with a pulse varying from ground potential to the first negative potential, from the first negative potential back to ground potential, and then from ground potential to the first positive potential. The anode is supplied with a writing pulse varying from a third positive potential to a fourth positive potential for data writing when the pulses of the first and second sustaining electrodes are both at ground potential. The cathode is supplied with a negative scanning pulse varying from a third negative potential to a fourth negative potential. The cathode is supplied with a negative erasing pulse having an amplitude equal to the different between the third and fourth potentials for erasing the written data after a predetermined time has elapsed. Thus, the durability of the plasma display panel can be improved.

11 Claims, 2 Drawing Sheets

STRUCTURE AND DRIVING METHOD OF A PLASMA DISPLAY PANEL

BACKGROUND OF THE INVENTION

The present invention relates to a plasma display panel, and more particularly to a structure and driving method of a plasma display panel.

In the pulse memory of a conventional plasma display panel of NHK, since display anodes simultaneously carry out the display and discharge sustainment functions, a voltage drop occurs due to the linear resistance of the display anodes, which, for stable display, limits materials which may constitute the anode. Moreover, in the circuitry, the simultaneous supply of data and the sustaining pulses to anodes is not easy for practical operation, and is accompanied by severe limitations.

SUMMARY OF THE INVENTION

It is the object of the present invention to provide a structure and driving method of a plasma display panel capable of increasing efficiency.

To achieve the above objects of the present invention, there is provided a plasma display panel comprising:

stripe-like anodes and barrier ribs formed on an upper face plate;

first sustaining electrodes formed over the whole inner surface of a lower rear plate; and stripe-like cathodes formed on the first sustaining electrodes and insulated from the first sustaining electrodes by interposing dielectric layers between the first sustaining electrodes and cathodes and respectively connected to external capacitors via a common node thereby serving as second sustaining electrodes.

The driving method of the above plasma display panel according to the present invention is such that the first sustaining electrode is supplied with a pulse varying from ground potential to a first positive potential, from the positive potential back to ground potential, and then from ground potential to a first negative potential;

the second sustaining electrode is supplied with a pulse varying from ground potential to the first negative potential, from the first negative potential back to ground potential, and then from ground potential to the first positive potential;

the anode is supplied with a writing pulse varying from a third positive potential to a fourth positive potential for data writing, when the pulses of the first and second sustaining electrodes are both at ground potential and the cathode is supplied with a negative scanning pulse varying from a third negative potential to a fourth negative potential; and the cathode is supplied with a negative erasing pulse having an amplitude equal to the difference between the third and fourth potentials, for erasing the written data after a predetermined time has elapsed.

Otherwise, the driving method of the above plasma display panel according to the present invention is such that the first sustaining electrode is supplied with a pulse varying from ground potential to a first positive potential, then from the first positive potential back to ground potential;

the second sustaining electrode is supplied with a pulse varying from ground potential to the first positive potential, then from the first positive potential back to ground potential;

the anode is supplied with a writing pulse varying from a fourth positive potential to a fifth positive potential for data writing, when the pulses of the first and second sustaining electrodes are both at ground potential and the cathode is supplied with a negative scanning pulse varying from a third positive potential to a third negative potential; and the cathode is supplied with a negative erasing pulse having an amplitude equal to the difference between the fourth and fifth positive potentials, for erasing the written data after a predetermined time has elapsed.

BRIEF DESCRIPTION OF THE DRAWINGS

The above objects and other advantages of the present invention will become more apparent by the following description with reference to accompanying drawings, in which.

DETAILED DESCRIPTION OF THE INVENTION

Figure 1:
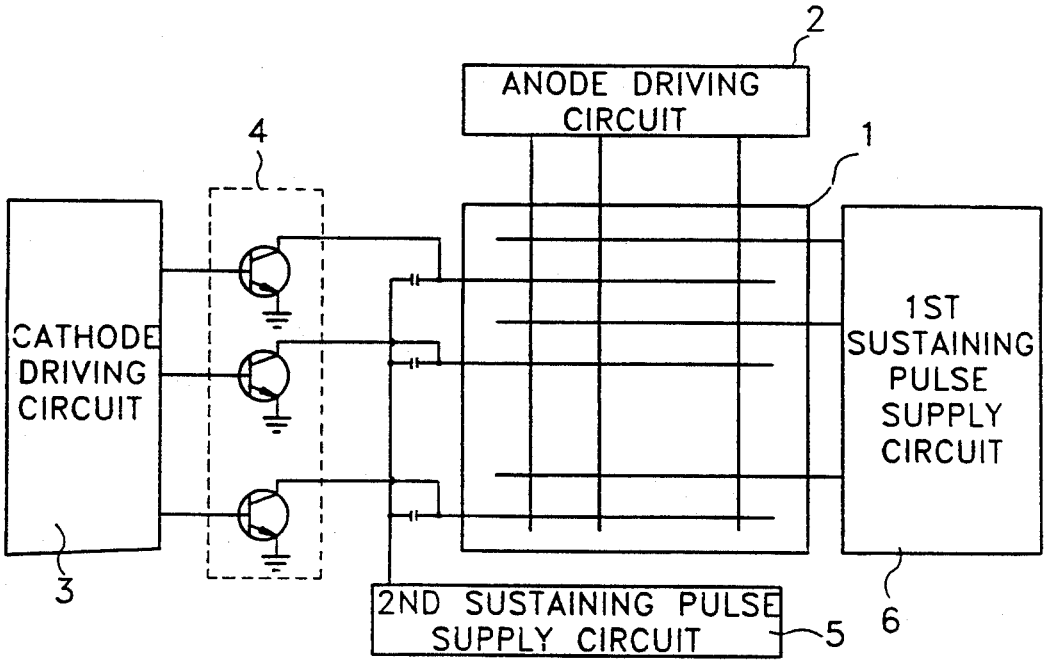
FIG. 1 illustrates a driving circuit of a plasma display panel according to the present invention.

FIG. 1 schematically illustrates the operation of a driving circuit of a plasma display panel according to the present invention. The driving circuit includes: a plasma display panel 1 which has anodes and cathodes arranged so as to intersect each other, and sustaining electrodes arranged parallel with the cathodes; an anode driving circuit 2 for supplying data to the anodes of plasma display panel 1; a cathode driving circuit 3 for scanning the cathodes of plasma display panel 1; switching transistors 4 each having its base connected to the output of cathode driving circuit 3, its emitter grounded, and its collector connected to respective cathodes; a second sustaining pulse supply circuit 5 for supplying a second sustaining pulse to the cathodes through each capacitor formed on respective cathodes; and a first sustaining pulse supply circuit 6 for supplying a first sustaining pulse to the sustaining electrodes. That is, according to the structure of the present invention, the cathodes are supplied with the output signals from cathode driving circuit 3 while scanning, and with signals from the second sustaining pulse supply circuit 5 via the capacitors while sustaining operation. A sustaining pulse from the just sustaining pulse supply circuit 6 is supplied to the sustaining electrodes arranged parallel to the cathodes. Accordingly, the cathodes of the present invention serve as scanning cathodes or as sustaining electrodes which receive the sustaining pulse from the first sustaining pulse supply circuit.

Figure 2:
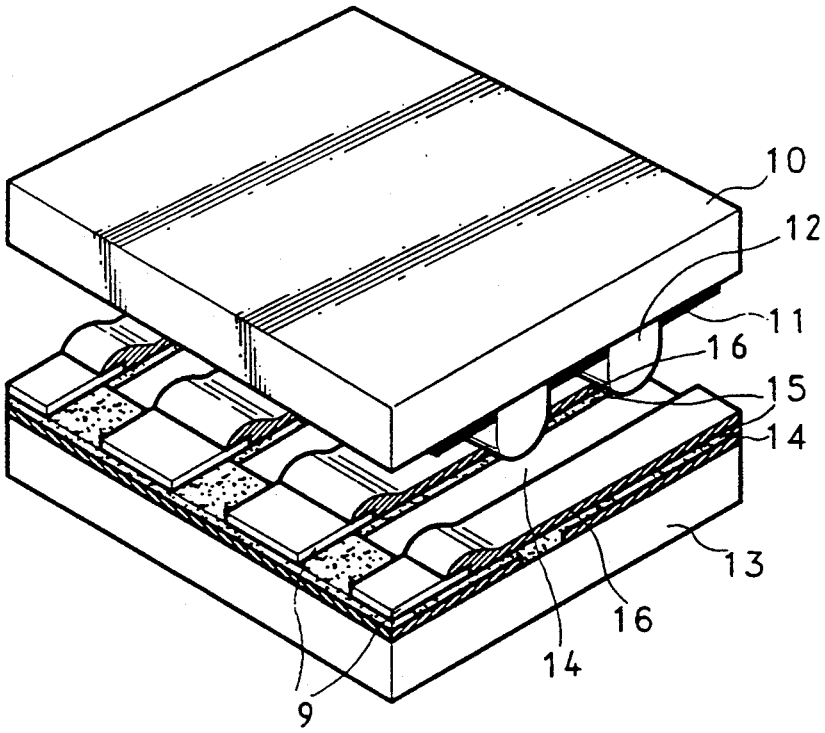
FIG. 2 shows a structure of the plasma display panel according to the present invention.

FIG. 2 illustrates the structure of the plasma display panel according to the present invention.

In FIG. 2, the anodes 11 and barrier ribs 12 are formed on the upper glass face plate 10, the sustaining electrodes 14 are formed on the lower glass rear plate 13, and the cathodes 16 are formed on the sustaining electrodes 14. Here, the sustaining electrodes 14 and the cathodes 16 are insulated from each other by a dielectric material 15, and the sustaining electrodes 14 are exposed to gas. In the above structure, all anodes 11, cathodes 16, and sustaining electrodes 14 are exposed to gas, which is a complete DC-type structure. The reference numeral 9 denotes a terminal through which the electric power is supplied.

Figure 3A:
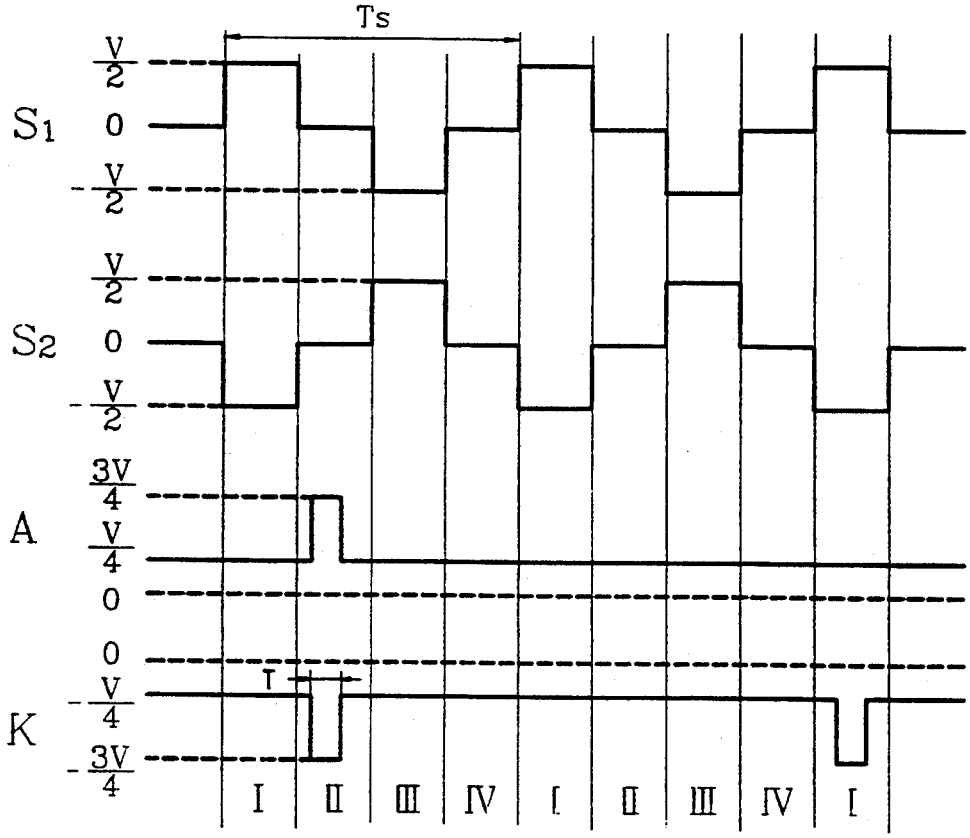
FIG. 3A shows one embodiment of a driving method of the plasma display panel according to the present invention.

FIG. 3A shows one embodiment of a driving method of the plasma display panel according to the present invention.

In FIG. 3A, a period Ts and amplitude V of the sustaining pulse are supplied to the sustaining electrode. Here, a sustaining electrode 14 is supplied with a pulse S1 which varies from zero volt to +V/2 volts, from +V/2 volts back to zero volt, and then from zero volt to −V/2 volts. A sustaining electrode 16 (the cathodes) is supplied with a pulse S2 which varies from zero volt to −V/2 volts, from −V/2 volts back to zero volt, and then from zero volt to V/2 volts. During an interval II wherein the pulse of the sustaining electrodes are at zero potential, a scanning pulse which has an amplitude of V/2 is supplied to the cathode, and a writing pulse which has an amplitude of V/2 is supplied to the anode. In addition, an erasing pulse is supplied during an interval I after a predetermined time has elapsed. Here, the duration of the pulse for erasing becomes approximately 1/5 to 1/10 T, where "T" indicates the period of the erasing pulse.

Figure 3B:
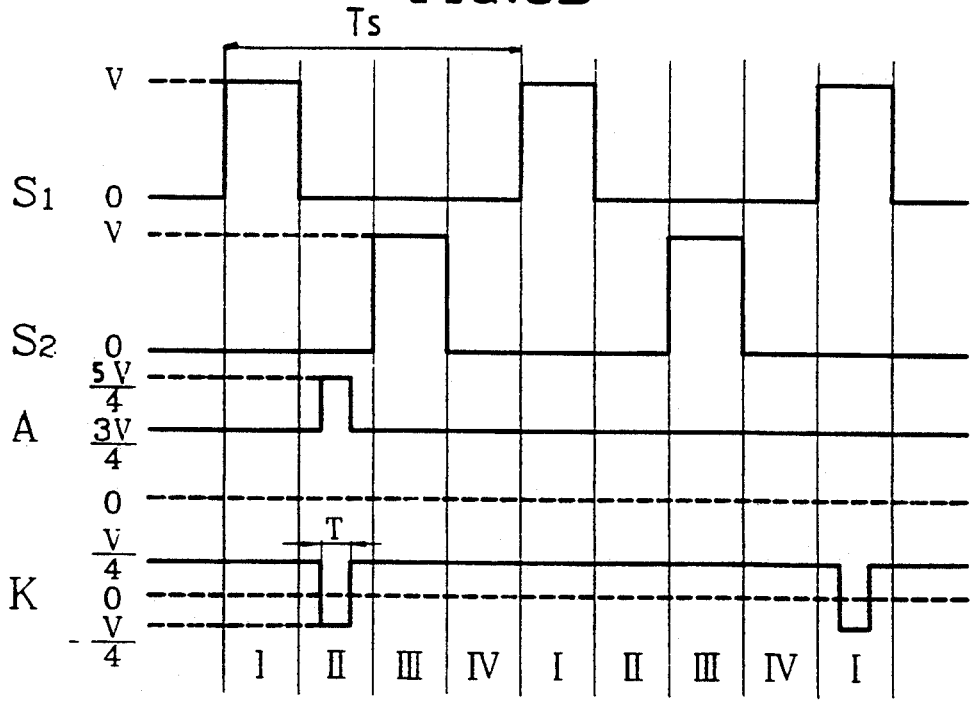
FIG. 3B shows another embodiment of a driving method of the plasma display panel according to the present invention.

FIG. 3B shows another embodiment of a driving method of a plasma display panel according to the present invention.

In FIG. 3B, a sustaining electrode 14 is supplied with a pulse S1 which varies from zero volt to +V volts, then from +V volts back to zero volt, and a sustaining electrode 16 is supplied with a pulse S2 which also varies from zero volt to +V volts, then from +V volts back to zero volt but with a delayed time as compared with the pulse S1. The pulses supplied to the sustaining electrodes are pulses whose duration is "T," and whose amplitude is "V." During an interval II, if a scanning pulse is applied to the cathode, and a write pulse for writing data is applied to the anode, data is written in. The scanning pulse (K) is a pulse which varies from −V/4 volts to +V/4 volts, making its amplitude V/2 volts. The writing pulse (A) is a pulse which varies from +3 V/4 volts to +5 V/4 volts, making its amplitude also V/2 volts. The written data is erased by applying a pulse having an amplitude of V/2 volts during interval I. Here, the duration of the erasing pulse is one tenth to one fifth of the period of the writing pulse.

Based on the above-described structure and driving methods, the operation of the plasma display panel of the present invention will be described below. First, the method illustrated with reference to FIG. 3A is as follows.

During writing interval II, priming particles are created due to the potential difference between pulses supplied to the anodes and cathodes. In an interval III, due to the potential difference between a pulse S1 having −V/2 volts supplied to sustaining electrode 14, and a pulse S2 having V/2 volts supplied to sustaining electrode 16, the priming particles move from sustaining electrode 16 to sustaining electrode 14, thereby sustaining discharge. Here, an interval IV maintains the discharging state as in interval III. In the following interval I, due to the potential difference between pulse S1 having V/2 volts supplied to sustaining electrode 14, and a pulse S2 having −V/2 volts supplied to sustaining electrode 16, the priming particles move from sustaining electrode 14 to sustaining electrode 16, thereby maintaining the discharging state. After repeating the above operations, when an erase pulse for erasing data is supplied during interval I, the priming particles disappear, thereby stopping discharge. The erasing is accomplished by eliminating the priming particles. Here, if the time required for forming the priming particles is shortened, the priming particles are eliminated without being created. Accordingly, the pulse width of the erasing pulse is shortened by design.

Hereinafter, the driving method illustrated in FIG. 3B will be described in detail.

During writing interval II, printing particles are created by the potential difference between the pulses supplied to the anodes and cathodes. In interval III, due to the potential difference between pulse S1 having zero volt supplied to sustaining electrode 14, and pulse S2 having a potential of 1 V supplied to sustaining electrode 16, the printing particles move from sustaining electrode 16 to sustaining electrode 14, thereby maintaining the discharging state. In the interval IV, the discharging state is maintained as in interval III. In the following interval I, due to the potential difference between pulse S1 having 1 V supplied to sustaining electrode 14, and pulse S2 of zero volt supplied to sustaining electrode 16, the printing particles move from sustaining electrode 14 to sustaining electrode 16, to sustain the discharge. After repeating the above operations, when an erasing pulse for erasing data is supplied during interval I, the priming particles disappear, thereby stopping the discharge.

As a result, in the present invention, the discharge sustainment is not performed through display anodes, but through a sustaining electrode which is separately formed, and the other sustaining electrode is realized by separate capacitor and common terminal under the scanning electrode, thereby enhancing the efficiency of a plasma display panel.

What is claimed is:

1. A plasma display panel comprising:

a first plate;

stripe-like anodes and barrier ribs disposed on said first plate;

a second plate having an inner surface;

first sustaining electrodes disposed on the inner surface of said second plate for sustaining a discharge;

dielectric layers respectively disposed on said first sustaining electrodes; p1 stripe-like cathodes respectively disposed on said dielectric layers and serving as second sustaining electrodes for sustaining the discharge; and external capacitors, each including first and second terminals, said strip-like cathodes being respectively connected to said first terminals at respective common nodes.

2. A plasma display panel as claimed in claim 1, wherein said first sustaining electrodes are arranged as stripes in the same direction of said cathodes.

3. A plasma display panel as claimed in claim 1, wherein said first sustaining electrodes are arranged as stripes in the same direction of said anodes.

4. A plasma display panel as claimed in claim 1, wherein said first sustaining electrodes are formed as one plate.

5. A driving method of a plasma display panel comprising: stripe-like anodes and barrier ribs formed on an upper face plate; first sustaining electrodes formed over the whole inner surface of a lower rear plate; and stripe-like cathodes formed on said first sustaining electrodes and insulated from said first sustaining electrodes by dielectric layers interposed between said first sustaining electrodes and cathodes, and respectively connected to external capacitors via a common node, thereby serving as second sustaining electrodes, wherein said first sustaining electrode is supplied with a pulse varying from ground potential to a first positive potential, from said first positive potential back to ground potential, and then from ground potential to a first negative potential;

said second sustaining electrode is supplied with a pulse varying from ground potential to said first negative potential, from said first negative potential back to zero potential, and then from ground potential to said first positive potential;

said anode is supplied with a writing pulse varying from a third positive potential to a fourth positive potential for data writing, when said pulses of said first and second sustaining electrodes are both at ground potential and said cathode is supplied with a negative scanning pulse varying from a third negative potential to a fourth negative potential; and said cathode is supplied with a negative erasing pulse having an amplitude equal to the difference between said third and fourth potentials, for erasing said written data after a predetermined time has elapsed.

6. A driving method of a plasma display panel as claimed in claim 5, wherein the duration of said erasing pulse is one tenth to one fifth the period of said writing pulse.

7. A driving method of a plasma display panel comprising: stripe-like anodes and barrier ribs formed on an upper face plate; first sustaining electrodes formed over the whole inner surface of a lower rear plate; and cathodes formed on said first sustaining electrodes and insulated from said first sustaining electrodes by dielectric layers interposed between said first sustaining electrodes and cathodes, and respectively connected to external capacitors via a common node, thereby serving as second sustaining electrodes, wherein said first sustaining electrode is supplied with a pulse varying from ground potential to a first positive potential, then from said first positive potential back to ground potential;

said second sustaining electrode is supplied with a pulse varying from ground potential to said first positive potential, then from said first positive potential back to ground potential;

said anode is supplied with a writing pulse varying from a fourth positive potential to a fifth positive potential for data writing, when said pulses of said first and second sustaining electrodes are both at ground potential and said cathode is supplied with a negative scanning pulse varying from a third positive potential to a third negative potential; and said cathode is supplied with a negative erasing pulse having an amplitude equal to the difference between said fourth and fifth positive potentials, for erasing said written data after a predetermined time has elapsed.

8. A driving method of a plasma display panel as claimed in claim 7, wherein the duration of said erasing pulse is one tenth to one fifth the period of said writing pulse.

9. The plasma display panel as recited in claim 1 including a first sustaining pulse supply circuit connected to said first sustaining electrodes.

10. The plasma display panel as recited in claim 1 including a second sustaining pulse supply circuit connected to said second terminals of said external capacitors.

11. The plasma display panel as recited in claim 1 including a gas disposed between said first and second plates wherein said first sustaining electrodes are exposed to said gas.

* * * * *

UNITED STATES PATENT AND TRADEMARK OFFICE

CERTIFICATE OF CORRECTION

PATENT NO. : 5,332,949

DATED : July 26, 1994

INVENTOR(S) : KIM

It is certified that error appears in the above-identified patent and that said Letters Patent is hereby corrected as shown below:

Column 4, line 50, delete "p1".

Signed and Sealed this

First Day of November, 1994

*Attest:*

*Attesting Officer*

Bruce Lehman

BRUCE LEHMAN

*Commissioner of Patents and Trademarks*